US006027381A

United States Patent [19]

Lok

[11] Patent Number: 6,027,381

[45] Date of Patent: Feb. 22, 2000

[54] INSERT MOLDED COMPRESSION CONNECTOR

[75] Inventor: Gordon Lok, Montebello, Calif.

[73] Assignee: Hon Hai Precision Ind. Co., Ltd., Taipei Hsien, Taiwan

[21] Appl. No.: 09/222,580

[22] Filed: Dec. 28, 1998

[51] Int. Cl.[7] ..... H01R 13/405

[52] U.S. Cl. ..... 439/736

[58] Field of Search ..... 439/626, 660, 439/736, 862, 71, 630, 66

[56] References Cited

U.S. PATENT DOCUMENTS 5,655,913 8/1997 Castaneda et al. ..... 439/66
5,746,626 5/1998 Kwiat et al. ..... 439/630

FOREIGN PATENT DOCUMENTS 2704806 8/1978 Germany ..... 439/736

*Primary Examiner*—Michael L. Gellner
*Assistant Examiner*—Barry M. L. Standig
*Attorney, Agent, or Firm*—Wei Te Chung

[57] ABSTRACT

A compression connector includes an insulator insert molded with a plurality of contact elements. Each contact element has a terminal portion, a cantilevered portion, and pair of engaging brackets upwardly extending from opposite edges of the terminal portion. Each bracket defines a notch in opposite distal ends thereof and a hole in a central portion thereof. The hole facilitates proper bending of the bracket with regard to the terminal portion during a metal stamping and bending process. The insulator is formed around the brackets and the terminal portions are flush with a bottom surface of the insulator. Plastic molded through the aligned holes and notches strengthens the engagement between the contact elements and the insulator.

6 Claims, 2 Drawing Sheets

INSERT MOLDED COMPRESSION CONNECTOR

BACKGROUND OF THE INVENTION

1. Field of The Invention

The present invention relates to a compression connector, and particularly to a compression connector having an insulator insert molded with a plurality of contact elements.

2. The Prior Art

Reliability of portable devices such as mobile phones and laptop computers require power supplied from a battery associated therewith. As portable devices become increasingly compact, a compression connector mounted thereon for conducting electrical energy between circuit boards faces strict design requirements. All batteries have a limited lifetime and must be replaced when the electrical energy is consumed thus the compression connector is subject to repeated depression and extension.

A compression connector generally comprises an insulative housing and a number of contact elements securely engaged in associated channels defined therein. In a conventional design, the engagement is achieved by forming barbs on each contact element which extend laterally along a direction parallel to a general plane defined by the contact elements. The contact elements are then interferentially received in the corresponding channels of the housing. However, the provision of the barbs increases a lateral dimension of the contact element and thus reduces a thickness of walls between adjacent channels possibly resulting in damage to the walls.

In another design disclosed in U.S. Pat. No. 5,746,626 issued to Kwiat et al. on May 5, 1998, each contact element comprises a front leg and a rear leg each being folded around a corresponding edge of the housing after insertion into a corresponding passageway. The lateral ends of the legs abut against a bottom surface of the housing for soldering to a PC board. Such a contact element has a complicated structure whereby manufacture and assembly thereof is time and cost inefficient. Furthermore, if the legs are not properly folded around the edges of the housing, the engagement therebetween will not be secure.

Hence, an improved compression connector is requisite to overcome the disadvantages of the prior art.

SUMMARY OF THE INVENTION

Accordingly, an objective of the present invention is to provide a compression connector having an insulator insert molded with a plurality contact elements.

Another objective of the present invention is to provide a compression connector having contact elements with upwardly extending engaging brackets for strengthening the engagement between the contact elements and an insulator.

To fulfill the above mentioned objectives, a compression connector in accordance with the present invention includes an insulator insert molded with a plurality of contact elements. Each contact element has a terminal portion, a cantilevered portion, and a pair of engaging brackets upwardly extending from opposite edges of the terminal portion. Each bracket defines a notch in opposite distal ends thereof and a hole in a central portion thereof. The hole facilitates proper bending of the bracket with regard to the terminal portion during a metal stamping and bending process. The insulator is formed around the brackets and the terminal portions are flush with a bottom surface of the insulator. Plastic molded through the aligned holes and the notches strengthens the engagement between the contact elements and the insulator.

These and additional objectives, features, and advantages of the present invention will become apparent after reading the following detailed description of the preferred embodiment taken in conjunction with the appended drawing figures.

DETAILED DESCRIPTION OF THE PREFERRED EMBODIMENT

Reference will now be made in detail to the preferred embodiment of the present invention.

Figure 1:
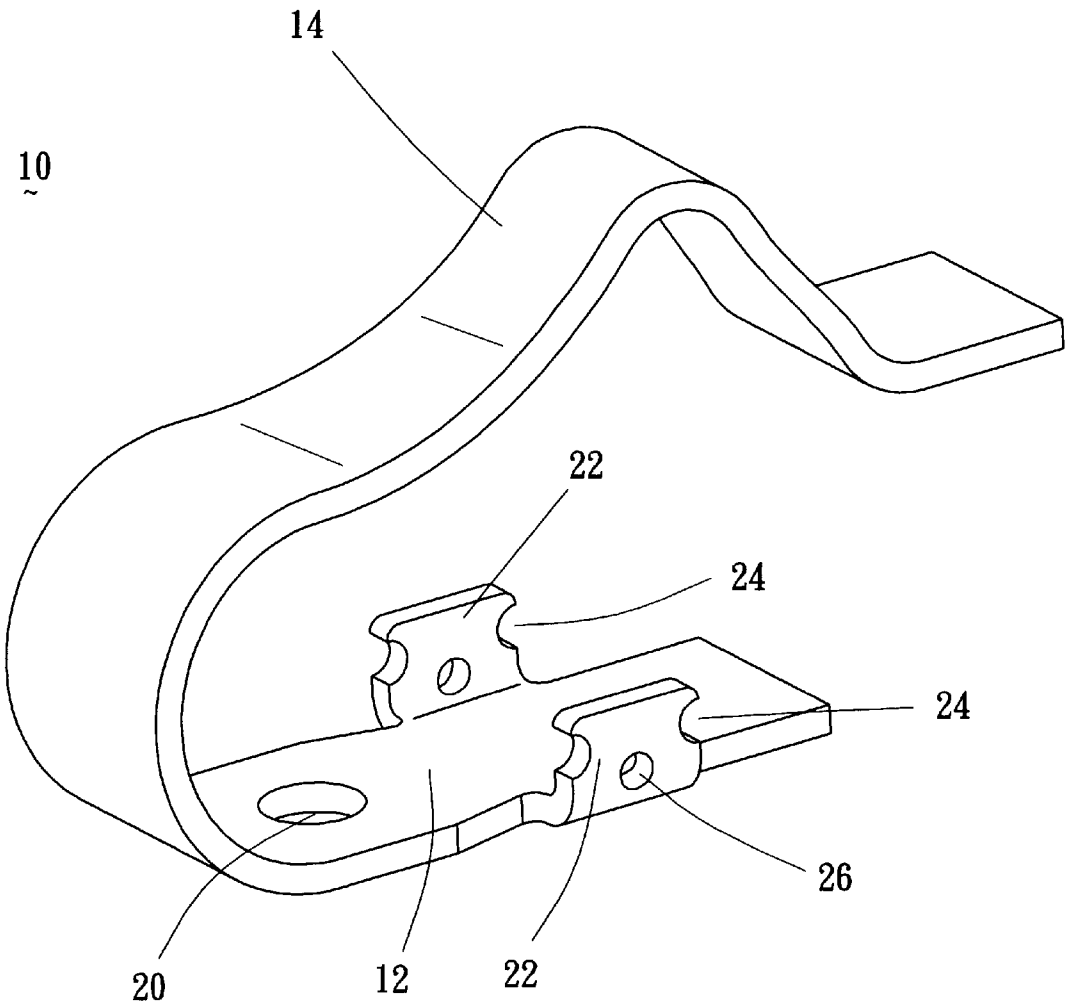
FIG. 1 is a perspective view of a contact element in accordance with the present invention.
Figure 2:
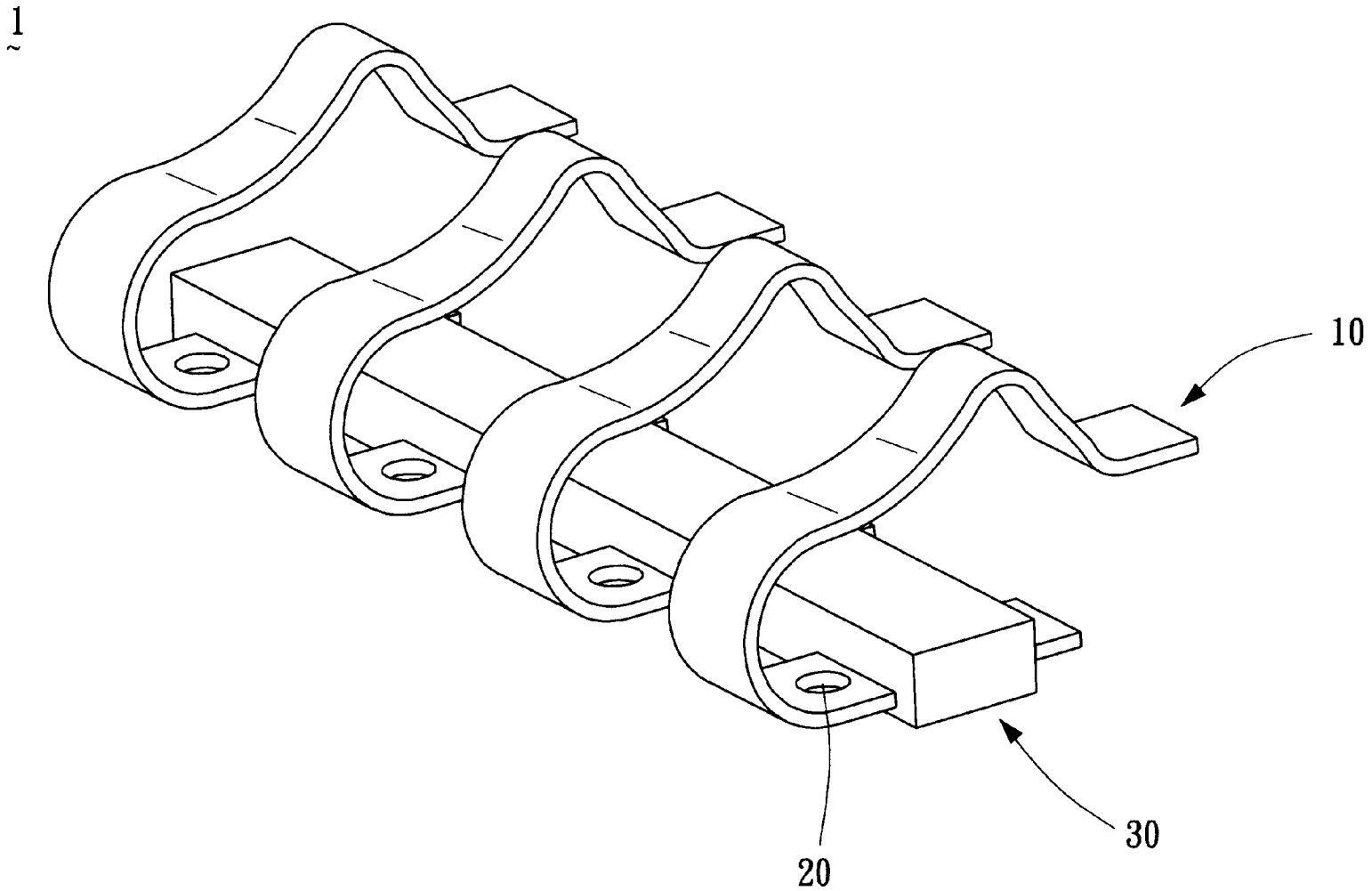
FIG. 2 is a perspective view of a compression connector in accordance with the present invention.

Referring to FIGS. 1 and 2, a contact element 10 in accordance with the present invention includes a terminal portion 12 adapted for mounting to a PC board (not shown), a cantilevered portion 14 adapted for electrically connecting with a component (not shown), and a pair of engaging brackets 22 upwardly extending from opposite edges of the terminal portion 12. Each bracket 22 is formed along a predetermined length of the terminal portion 12 and defines a notch 24 in opposite distal ends thereof. A hole 26 is defined in a central portion of each bracket 22 for facilitating proper bending of the bracket 22 with regard to the terminal portion 12 during a metal stamping and bending process.

A solder opening 20 is defined through the terminal portion 12 for facilitating soldering of the contact element 10 to the PC board. The provision of the opening 20 promotes an efficient and accurate surface mounting process whereby excess solder will not overflow beyond outer edges of the contact element 10 resulting in a possible short circuit.

An insert molding procedure is enacted to form the insulator 30 around the contact elements 10 whereby the terminal portions 12 are flush with a bottom surface of the insulator 30. Plastic molded through the aligned holes 26 and notches 24 strengthens the engagement between the contact elements 10 and the insulator 30.

It can be readily understood from the above detailed description of the present invention that the contact elements 10 are securely engaged with the insulator 30 due to the plastic molded through the aligned holes 26 and notches 24 of the brackets 22 acting like a supporting rod extending therethrough. Such a design is novel and advantageous over the prior art and should qualify to be granted a patent.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A compression connector comprising an insulator insert molded with a plurality of contact elements, each contact element including:

a terminal portion adapted for mounting to a circuit board;

a cantilevered portion adapted for electrically connecting with a component;

and a pair of engaging brackets upwardly extending from opposite edges of the terminal portion, each bracket defining:

a pair of notches in opposite distal ends thereof; and a hole in a central portion thereof;

wherein plastic molded through the aligned holes strengthens the engagement between the contact elements and the insulator.

2. The connector as described in claim 1, wherein plastic is molded through the aligned notches.

3. The connector as described in claim 1, wherein the terminal portion defines a solder opening therein for facilitating soldering of the contact element to a PC board.

4. The connector as described in claim 1, wherein the terminal portions are generally flush with a bottom surface of the insulator after the insert molding process is completed.

5. A contact for use with a compression connector, comprising:

a terminal portion adapted to be mounted to a printed circuit board;

a cantilevered portion extending upward from the terminal portion and adapted for electrically connecting with a component; and a pair of engaging brackets upward extending from the terminal portion below the cantilevered portion, each of said brackets defining a hole.

6. The contact as described in claim 5, wherein each of said brackets further includes a pair of notches in opposite distal ends thereof.

* * * * *